United States Patent [19]

Jaritz et al.

[11] Patent Number: 4,686,877

[45] Date of Patent: Aug. 18, 1987

[54] LIQUID JET CUTTING MACHINE FOR CUTTING WORKPIECES, ESPECIALLY FLAT WORKPIECES

[75] Inventors: Erich Jaritz, Kapfenberg; Günter Krammer, Vienna, both of Austria

[73] Assignee: Vereinigte Edelstahlwerke Aktiengesellschaft (VEW), Vienna, Austria

[21] Appl. No.: 848,922

[22] Filed: Apr. 7, 1986

[30] Foreign Application Priority Data

Apr. 16, 1985 [AU] Austria ..... 1149/85

[51] Int. Cl.[4] ..... B26F 3/00

[52] U.S. Cl. ..... 83/177; 83/53; 83/925 R; 83/701; 51/321; 51/410; 181/211; 296/24 R

[58] Field of Search ..... 83/177, 53, 928, 701, 83/859; 51/426, 321, 268; 408/77; 219/121 PC, 121 PG, 121 LG-LL; 296/24 R, 33 K; 181/211

[56] References Cited

U.S. PATENT DOCUMENTS

| | | | |
|---|---|---|---|
| 2,811,111 | 10/1957 | Levitz | 296/24 R |
| 2,869,291 | 1/1959 | Clay | 51/426 X |
| 3,532,014 | 10/1970 | Franz | 83/177 X |
| 3,538,803 | 11/1970 | Joseph | 83/701 |
| 3,559,343 | 2/1971 | Foster | 51/410 |
| 3,860,085 | 1/1975 | Gilbert | 51/268 X |
| 4,018,117 | 4/1977 | Patterson | 83/171 X |
| 4,070,938 | 1/1978 | Lines | 83/71 |
| 4,463,639 | 8/1984 | Gerber | 83/177 X |

*Primary Examiner*—Donald R. Schran
*Attorney, Agent, or Firm*—Werner W. Kleeman

[57] ABSTRACT

The liquid jet cutting machine contains at least one cutting head provided with an apparatus for producing high-pressure liquid at pressures in excess of 1000 bar. The cutting head delivers a high-pressure liquid cutting jet and is preferably movable or guideable along a predetermined cutting path. An apparatus is provided for holding the workpiece to be cut at least during the cutting operation. At least the high-pressure liquid producing apparatus, preferably inclusive of a drive and/or auxiliary aggregate, the cutting head, the holding apparatus and a cutting jet collector are connected with a common frame and form a positionally displaceable transport unit. The cutting head is preferably automatically controllable in its movements by a guiding apparatus which constitutes an industrial robot. The holding apparatus may also perform controllable movements and preferably contains an infeed and/or outfeed device for the workpiece to be cut, as well as a drain device for the spent jet liquid. The components are at least indirectly, preferably releasably connected with the common frame which may constitute a multi-part frame or contain a common base plate or the like. The transport unit may be secured at a predetermined position, especially at the ground or floor or may preferably be anchored thereat in a vibration damping manner.

37 Claims, 4 Drawing Figures

LIQUID JET CUTTING MACHINE FOR CUTTING WORKPIECES, ESPECIALLY FLAT WORKPIECES

CROSS REFERENCE TO RELATED APPLICATION

The present application is related to the copending, commonly assigned U.S. patent application Ser. No. 06/723,564, filed Apr. 15, 1985, and entitled "Liquid Jet Cutting Apparatus", now U.S. Pat. No. 4,594,924, the disclosure of which is incorporated herein by reference.

BACKGROUND OF THE INVENTION

The present invention broadly relates to a new and improved construction of a liquid jet cutting machine for cutting workpieces, especially flat workpieces.

In its more particular aspects, the present invention specifically relates to a new and improved construction of a liquid jet cutting machine for cutting workpieces, especially flat workpieces, and contains at least one cutting head. The liquid jet cutting machine further contains high-pressure liquid producing means for producing high-pressure liquid which has a pressure exceeding 1000 bar and which is fed to the cutting head which, in turn, delivers a high-pressure cutting jet. Guide means are provided for moving or guiding the cutting head along a predetermined cutting path. There are further provided holding means for holding the workpiece or material to be cut at least during the cutting operation.

Liquid jet cutting machines of the aforementioned type which work using a jet of a preselected liquid, usually water, focus such liquid and force the liquid through a nozzle at high-pressures of frequently several thousand bar. Various constructions of such liquid jet cutting machines are known for some time and are used for cutting preferably flat workpieces of various materials such as, for example, textiles, foodstuffs, plastics, building materials and, if desired, even metals. These liquid jet cutting machines permit very clean cuts at high cutting feed rates and are suitable for articles or objects having complicated, often three-dimensionally extending cutting contours and also are of interest, for example, when a large number of similar elements must be cut from a sheet of material which is difficult or nearly impossible to cut in any other manner. Due to the multiple possibilities for the use of such types of liquid jet cutting machines there also exists a tendency of directly using such liquid jet cutting machines during a sequential manufacturing process, for instance, within assembly lines which presently are highly automated. Furthermore, there exists the tendency of abandoning mass production and moving towards a more flexible manufacturing method like custom manufacturing. Thus, for example, it is presently frequently the case in the automotive industry that each production facility possesses a number of production lines, for instance, for different or differently equipped models and in such production facility the production lines are often sequentially used, depending upon the requirements and demand.

Furthermore, there are increasingly found production lines which, as such, are not rigidly preset right from the start, but possess improved internal flexibility essentially due to the fact that their individual work stations are variable with respect to their locations or can be exchanged for other work stations without problem. The production line thus is modularly constructed and contains flexible, exchangeable production stages. In this manner there is rendered economically possible, for example, the economic automatic production of relatively small but quickly changing series of products. In the case that high-power cutting operations are intended to be carried out in one or a number of such production lines, for example, for manufacturing dash boards or bumpers, then, it is necessary to equip, for instance, each one of the production lines with its own high-pressure liquid cutting machine complete with the related supply, drain and auxiliary aggregates. Such installation would cause considerable technical complications and thus high costs when also considering the idle times of the expensive machines in the production lines.

SUMMARY OF THE INVENTION

Therefore, with the foregoing in mind, it is a primary object of the present invention to provide a new and improved construction of a liquid jet cutting machine for cutting workpieces, especially flat workpieces and which liquid jet cutting machine does not exhibit the aforementioned drawbacks and shortcomings of the prior art constructions.

Another important object of the present invention is to provide a new and improved construction of a liquid jet cutting machine for cutting workpieces, especially flat workpieces, and which liquid jet cutting machine is constructed such as to eliminate the disadvantage of providing each production line with its own liquid jet cutting machine at all locations or stations where cutting operations are required to be carried out.

It is also a further significant object of the present invention to provide a new and improved construction of a liquid jet cutting machine for cutting workpieces, especially flat workpieces, and which liquid jet cutting machine is constructed such as to enable its use in a highly flexible and economical manner at different locations or stations of a manufacturing installation.

Now in order to implement these and still further objects of the invention, which will become more readily apparent as the description proceeds, the liquid jet cutting machine of the present development is manifested by the features that, at least the high-pressure liquid producing means preferably including associated drive means and/or associated auxiliary aggregates, at least one cutting head and its guide means including workpiece holding means, and cutting jet collecting means are connected with a mobile or displaceable transport unit which is capable of being placed at variable locations.

Preferably the guide means at such mobile transport unit are subject to controllable movements or displacements which are automatically controlled in a preferred embodiment. Such guide means may constitute an industrial robot. The workpiece holding means which are connected with the aforementioned mobile transport unit, preferably include infeed means and/or outfeed means for infeeding and outfeeding the workpiece to be cut and such infeed means and/or outfeed means may constitute, for example, a slidable table or plate and/or a rotatable table or plate. The cutting jet collecting means connected with the aforementioned transport unit, if desired, may contain drain means for draining the spent or used cutting jet liquid or medium, for example, at least one suction means, at least one collecting tank or the like.

The aforementioned components of the inventive liquid jet cutting machine are at least indirectly, preferably releasably connected with a common frame which, if desired, may constitute a multi-component frame or the like, and especially is constituted by a common main or base frame, a common base plate or the like. The transport unit preferably also contains easily handled or manipulatable disconnectable and connectable connecting elements, preferably plug-type connecting elements, at least for the supply of preferably electrical power, the jet-forming liquid or medium and for draining the spent or used cutting jet liquid or medium.

The mobile transport unit is constructed such that this transport unit can be blocked or secured at a preselected location, especially at the ground or floor or the like. Preferably the mobile transport unit can be anchored at the ground or floor in a vibration damping manner.

In accordance with the invention there is thus provided a substantially complete assembly containing means for supplying the high-pressure cutting liquid or medium and the cutting head which is connected therewith by means of high-pressure conduits including, for example, joints and flexible helical tubing. The assembly further contains the guide means for carrying and guiding the cutting head along a predetermined cutting path. Such guide means may constitute a elbow-type or joint-arm robot with high freedom of movement or mobility in three dimensions, or a Cartesian robot. The aforementioned substantially complete assembly also encompasses the workpiece holding means, namely, a cutting table or plate enabling positionally accurate and slip-proof holding of the workpiece during the cutting operation. This cutting table may contain, for example, a support or work plate including vacuum suction means for holding the workpiece. Such support or work plate additionally itself may be displaceable, for example, along coordinates or the like. Alternatively, the support of work plate may be displaceable relative to the cutting head which, then, may be fixedly positioned. The assembly further contains the feeding means including the infeed means for the workpiece to be cut, and also includes outfeed means for the workpiece which has been subjected to the cutting operation and such outfeed means may be identical with the infeed means. The aforedescribed components are connected with the common frame which may constitute a support frame, for example, formed by profiled or tubular structural members or the like and, if desired, reinforcing struts. The aforementioned components may also be connected with a common main or base plate or the like.

The arrangement of the high-pressure liquid producing means which, for example, contain a hydraulic pressure amplifier including associated drive means and have a great mass, results in an initial high stability at substantially increased strength or resistance of the mobile transport unit and its components relative to vibrations which particularly occur due to the rapidly varying movements of the guiding robot for the cutting head.

Preferably, the assembly further contains supply connections for the individual aggregates or components of the assembly, more specifically supply connections for supplying electric current and the liquid or medium of the cutting jet as well as further connections for draining the spent or used cutting jet liquid or medium. The related connecting elements preferably constitute easily and simply handled or manipulatable connecting elements which, as the case may be, establish or disconnect connections with related supply lines or conduits and the like. It should be noted that the supplied cutting liquid or medium as well as the drained spent or used cutting liquid or medium are not subjected to high pressure. There are thus insured short conversion times in the case of a change in the operating location, for example, from one production line to another production line or from one operating location or station to another within a predetermined production line. The exposure to only low levels of vibrations can be further improved by damping elements and/or specific anchoring elements particularly at the main frame.

In accordance with the teachings of the present invention, especially also with regard to labor and environmental protection, a particularly preferred embodiment of the inventive mobile transport unit contains a cabin or cell which, preferably is connected with the frame or framework of such mobile transport unit and which is preferably quadrangular in shape. The cabin or cell encloses at least the cutting head and its preferably provided guide means, especially an industrial robot, and at least the operating or working area or region thereof. Furthermore, the cabin or cell encloses the holding means for the workpiece to be cut and at least the operating or working area or region of such holding means as well as the cutting jet collecting means and, if desired, the high-pressure liquid producing means. The cabin or cell is surrounded, preferably enclosed, essentially on all sides with ultrasound insulation, especially ultrasonically insulating walls. The insulation from the ultrasound which is particularly damaging to health, also includes insulation from sound of audio frequencies and can be effected in accordance with any one of the known principles of sonic energy dissipation, such as by means of internal or in-space reflection, or mass and/or volume absorption.

In view of the construction costs it is advantageous to arrange walls, for example, within an auxiliary frame or the like which defines the cabin or cell, and to provide such walls with ultrasound protective coverings or layers or the like. Alternatively, there may be utilized commercially available wall elements of standard sizes which are already provided with ultrasound insulation. It is one advantage of such cabin or cell that protection towards the outside is also provided in the case of a leak due to a break or rupture inside the high-pressure liquid producing means, a rupture of the liquid or medium conducting line or conduits, or faulty positioning of the cutting head which delivers the cutting jet. When working with workpieces containing noxious substances, e.g. glass fibers or asbestos used for reinforcing plastics, concrete or the like, the cabin or cell has the further advantage that there is substantially prevented an escape of spray droplets containing very fine particles of such noxious substances into the environment of the liquid jet cutting machine.

In accordance with a further favorable embodiment of the inventive liquid jet cutting machine, the mobile transport unit preferably contains a further cabin or cell which is separately arranged from the first-mentioned cabin or cell. Such further cabin or cell contains the high-pressure liquid producing means and, if desired, electrical power control means and/or program control means and/or manual operating means. The aforementioned components are surrounded, preferably enclosed, essentially on all sides with ultrasound insulation, particularly ultrasound insulation walls. There is thus obtained a separation of the "wet" working area or region in which the high-pressure liquid or medium flows in a non-enclosed manner, i.e. the region in which the high-pressure liquid is discharged from the nozzle of the cutting head, and which high-pressure liquid penetrates the workpiece to be cut and is collected, from those parts or components of the installation in which such outflow of high-pressure liquid or medium does not occur.

Especially in combination with production lines in which personnel work or operate, especially where such personnel load or charge, the liquid jet cutting machine, the mobile transport unit or its main or base frame advantageously contains a number of cabins or cells which are spatially separated from each other by a walkable service or operator's passageway. One of such cabins or cells contains and essentially surrounds at least the cutting head preferably conjointly with its control means and the holding means for holding the workpiece to be cut; this cabin or cell further contains the infeed means and/or the outfeed means for the workpiece to be cut and which infeed and/or outfeed means face the substantially central service or operator's passageway. With such mode of construction, the workpiece to be cut can be introduced one side and the liquid jet cutting machine can be operated, for example, from a control panel in a further one of the cabins or cells on the other side of the service or operator's passageway. It is a further advantage that there exists a passageway through the mobile transport unit so that, for example, workpieces to be cut can be infed and cut workpieces can be outfed from the mobile transport unit by walking in and out from either end of the service or operator's passageway.

There can be avoided the arrangement of a specific support construction or the like for supporting the closure or ultrasound insulation of the cabin or cell from a foundation or floor in order to thereby prevent ultrasound reflection at such foundation or floor. Advantageously, the cabin or cabins of the mobile transport unit are therefore bounded at their bottom or base side by a sound insulation wall, especially an ultrasound insulation wall substantially in the region of the base frame.

Especially in view of environmental protection during the cutting of materials which are dangerous to health and to the environment, it is advantageous when at least the cabin or cell of the mobile transport unit and which cabin or cell surrounds the holding means for holding the workpiece to be cut and the liquid jet collecting means, possesses connecting means operatively connected with suction means for withdrawing essentially gaseous media and for conducting away any gases which may be formed. The connecting means preferably are of a type which can be easily handled and readily connected and disconnected. The mobile transport unit is thus capable of being connected with, for example, a gas exhaust system by means of which the mist or odors can be conducted away, for example, to a gas cleaning or filtering system.

Concerning the abovementioned connecting means and the connecting elements mentioned further hereinbefore, which preferably constitute plug-type connections, such connecting means and connecting elements are advantageously installed substantially in the region of one of the walls of the cabin or cell and on the outer surface, if desired, protruding from such outer surface, and still more particularly substantially close to the main frame or at the main frame. Such connecting means and connecting elements are connected to the main frame and, if desired, are also arranged beneath each other and spatially close to each other. Due to such arrangement there is achieved the beneficial effect of an additional time saving when the location of the mobile transport unit is changed.

It is further advantageous when, in addition to the power circuits and controls for the current operated drive aggregates of the high-pressure liquid producing means, the robot, the displacing means for the cutting table and the like, also the processor-operated control means, e.g. digital program control or the like are arranged at or in the mobile transport unit, especially inside the one cabin or cell. There can thus be avoided the laying of sensitive multi-conductor control cables with connecting elements to the various production locations of the production line or installation.

An undesirable danger to the supply and drain lines, for instance, when changing the location of the mobile transport unit, is substantially diminished and the positional fixation of such supply and drain lines is improved when, advantageously, the liquid conducting conduits and preferably also the electrical lines conducting electrical energy, electrical control pulses and electrical regulating pulses and the like are substantially placed in the region of a predetermined plane defined by the frame, especially the main or base frame or the base plate.

In order to achieve especially effective noise damping or insulation there can be further provided an arrangement in which the cabin or cell additionally surrounds, preferably encloses, the infeed means and/or outfeed means for the workpiece. There is thus achieved practically complete encapsulation of the liquid jet cutting machine.

In order to ensure, especially during a cutting operation, full enclosure of the liquid jet cutting machine to the outside while still retaining unobstructed infeed and outfeed of the workpiece to be cut, the cabin or cell advantageously contains at least substantially in the region of the workpiece infeed means and/or the outfeed means at least one opening which is provided with a closing element, preferably a sliding door which preferably is covered with an ultrasound damping material or insulation. In addition, the aforementioned closing element and the cabin or cell may further possess other wall elements which can be constructed, for example, as folding or wing doors in order to improve accessibility of the liquid jet cutting machine, for example, for exchange or repair operations.

In an advantageous manner, the aforementioned closing element of the cabin or cell is provided with an actuator which is operatively connected via a time delay, preferably through the control means, with actuating means governing the supply of the cutting jet liquid or medium to the cutting head. There is thus achieved the favorable effect that, after the workpiece to be cut has been infed and placed into the actual cutting region or area, first the closing element or sliding door is securely locked and only then the supply of cutting liquid or medium to the cutting head is started. Thereafter the cutting head is guided by the robot and carries out the cutting operation, whereupon the liquid or medium producing the cutting jet is cut off. Only then and after a time delay, can there be opened the closing element or sliding door and the cut or trimmed workpiece can be removed, e.g. together with the cutting waste. Thus, there is reliably avoided endangering the operating personnel by the jet of the high-pressure liquid or medium.

For increasing safety, at least the guide means, preferably the industrial robot, for guiding the cutting head and preferably also the supply means for supplying the high-pressure liquid or medium to the cutting head, can be cut off when portions of the ultrasound damping or insulation, especially access doors of the cabin or cell which constitutes a walk-in cabin or cell, are opened and/or when personnel enters such cabin or cell. Such cut-off can be effected via appropriate control means.

In a further advantageous variant the mobile transport unit, especially its main or base frame, possesses support legs, if desired, telescopic support legs or the like. The transport unit thus can be positionally correctly placed even on non-uniform foundations at a desired location of a production line without the requirement of using equalizing wedges or the like.

Furthermore, for enhancing mobility during positional changes, for instance, during custom manufacturing or production, it is especially advantageous when the mobile transport unit or, if desired, its main or base frame possesses at least passive transport assisting elements, especially at least one suspending hook and/or at least one eye and/or a predetermined number of rollers or wheels.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 3:
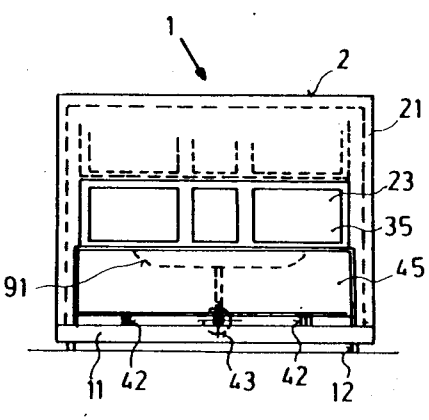
FIGS. 1 to 4 respectively show essentially simplified views of an exemplary embodiment of the inventive liquid jet cutting machine, namely a side view, a top plan view and views from the right and the left as seen from a substantially central passage or passageway between two cabins or cells of such liquid jet cutting machine.
Figure 4:
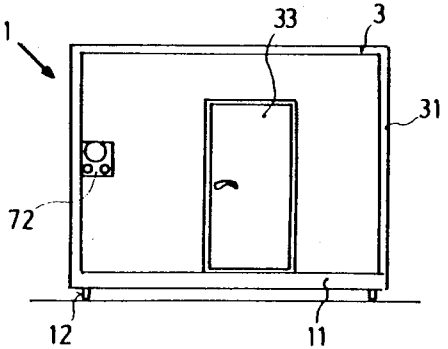
Figure 1:
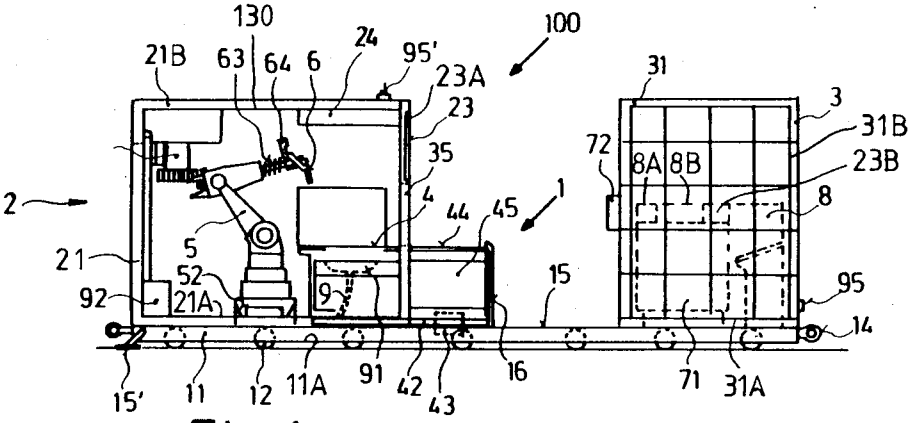
Figure 2:
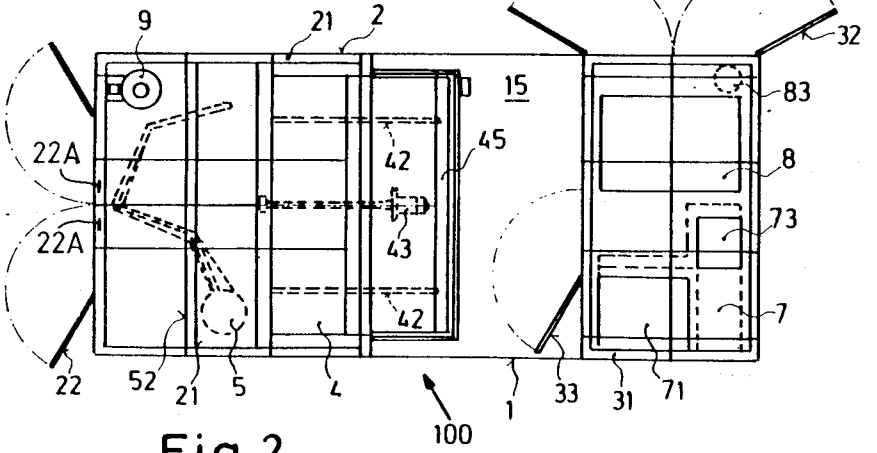

Describing now the drawings, it is to be understood that to simplify the showing thereof, only enough of the structure of the inventive liquid jet cutting machine has been illustrated therein as is needed to enable one skilled in the art to readily understand the underlying principles and concepts of the present invention. Turning now specifically to FIGS. 1 to 4 of the drawings, the machine illustrated therein by way of example and not limitation, will be seen to comprise a liquid jet cutting machine 100.

A cutting head 6 is arranged at the remote end of an elbow-type joint-arm or articulated-arm robot or guide means 5 which is displaceable in a guide 52 and which contains a plural number of actuator aggregates or units controlled by control means 71. The high-pressure cutting liquid or medium having a pressure in excess of 1,000 bar is produced by high-pressure liquid producing means 8 and supplied to the cutting head 6 by means of a high-pressure helical or coiled conduit 63 and high-pressure joint connections 64. The illustrated guide means 5 constitute an industrial robot which is connected in the illustrated embodiment with a main or base frame 11 or base plate 11A supporting a cabin or cell 2 and permits carrying out three-dimensional, difficult cuts and, if required, even undercuts. The industrial robot or guide means 5, in the case of appropriately constructed main or base frame 11, can also be displaceably arranged at a side wall 120 or a ceiling 130 of such cabin or cell 2. The guide 52 guiding the industrial robot or guide means 5 is connected with the main or base frame 11 of a mobile or displaceable transport unit 1 and such main or base frame 11 may constitute a multi-part frame or contain a common base plate 11A.

Holding means 4 for holding a workpiece during a cutting operation contain a working table or plate 44 and are also mounted on the main or base frame 11 or base plate 11A of the mobile or displaceable transport unit 1. The working table or plate 44 is displaceably arranged at a linear guide 42. Displacing means constituting a motor-driven spindle 43 control the displacement of the working table or plate 44 into the working region or area of the industrial robot or guide means 5 which possess the cutting head 6. The working table or plate 44 can also be displaced into the region of separate or combined workpiece infeed means and outfeed means 45 associated with the holding means 4 which are constructed as a so-called sliding or slidable table, but may also constitute a rotatable table.

A cutting jet collector 91 is also connected with the main or base frame 11 or base plate 11A of the mobile or displaceable transport unit 1. Such cutting jet collector 91 is arranged below the working table or plate 44 in the cutting position thereof and connected with drain means 9 including a collecting container 92 for spent or used cutting liquid or medium. The drain means 9 are also connected with the main or base frame 11. Indirectly connected with the displaceable transport unit 1 including the main or base frame 11 are suction means 24 which are operatively associated with a connection means 95' for removing spray mist and the like.

Frequently the working table or plate 44 of the holding means or sliding table 4 possesses a vacuum installation for positionally holding the workpiece to be cut after placement and during the infeed of such workpiece into the operating region or area of the cutting head 6 and during the actual cutting process. The aggregates or units, conduits and lines required therefor are also connected with the main or base frame 11 or base plate 11A.

All of the abovementioned components, which are connected with the main or base frame 11 or base plate 11A of the liquid jet cutting machine 100 and their associated working areas, are surrounded by a wall-type ultrasound damping or insulation means or protective wall 21 of the cabin or cell 2. This cabin or cell 2 is connected with the main or base frame 11 or base plate 11A and has an essentially quadrangular shape in the manner of a container. Such cabin or cell 2 immediately extends from the main or base frame 11 or base plate 11A and contains a sound and ultrasound damping sliding door 23 which closes an opening 35 in the region substantially above the workpiece feeding means, i.e. the displaceable working table or plate 44 of the holding means 4. This sliding door 23 is automatically opened for the infeed and outfeed of the workpiece on the working table or plate 44 before and after the cutting process. An actuator 23A is operatively connected with the sliding door 23 and with actuating means 23B which govern the supply of high-pressure liquid to the cutting head 6. The actuating means 23B are activated by the actuator 23A at a time delay and are associated with superordinate control means 7. In the illustrated displaceable transport unit 1 the infeed means 45 which also perform the function of the outfeed means, are arranged at the outside of the protective wall 21 or sliding door 23 of the cabin or cell 2. The feeding means including the infeed and/or outfeed means 45 face a walkable passageway 15 and can be easily charged or loaded by an operator performing the infeed and the removal of the workpiece from such walkable passageway 15.

The cabin or cell 2 constitutes a walkable cell and further possesses at least one element or hinged wall element 22 which forms part of the ultrasound damping means 21 for access to the aggregates or the cabin or cell 2. These hinged wall elements 22, as well as the floor of the cabin or cell 2 which contains, for instance, response means constituting a tread-operable switching mat, are preferably operatively connected by cut-off means 22A via the superordinate control means 7 with the industrial robot or guide means 5 and preferably and additionally with the supply means for supplying cutting liquid or medium to the cutting head 6. Consequently, the aforementioned elements or components are turned off when the hinged wall elements 22 are opened, for example, for carrying out repairs and/or when personnel enters the cabin or cell 2.

The main or base frame 11 or base plate 11A contains, on an other side of the walkable passageway 15 with respect to the cabin or cell 2, a further cabin or cell 3 which also possesses a sound and ultrasound damping wall construction 31 partially constituted by doors 32 and 33.

Inside the further cabin or cell 3 there are located components which, like all previously mentioned components in connection with the cabin or cell 2, are at least indirectly connected to the main or base frame 11 or base plate 11A. Such components essentially comprise the superordinate control means 7 for switching and controlling the entire working process of all components of the liquid jet cutting machine 100, robot control means 71, a manual feed control 72, for instance for performing special purposes or tasks, the high-pressure liquid producing means 8 including a drive unit 8A and an auxiliary aggregate 8B, and an operating and control panel 73 as well as a leakage collecting container 83 of the high-pressure liquid producing means 8.

All the aggregates or units of the liquid jet cutting machine 100, in the present instance within the two cabins or cells 2 and 3, are at least indirectly mechanically, preferably releasably connected with the main or base frame 11 or base plate 11A and preferably also possess in their base or bottom regions respective sound and ultrasound damping or insulation means or walls 21A or 31A and there is thus obtained the aforedescribed compact and flexible mobile displaceable transport unit 1. Connecting elements 95, which preferably constitute conventional plug-type connecting elements, for the supply of electric current and for the cutting liquid or medium supply and removal are arranged at the outer surface of a predetermined wall 31B of the further cabin or cell 3. The cabin or cell 2 possesses connecting means 95' for waste air or waste gas arranged at the outer surface of a predetermined wall 21B.

The mobile or displaceable transport unit 1 or its main or base frame 11 or base plate 11A possesses transport rollers or wheels 12 in order to facilitate positional changes, for example, from one production line to an other. Furthermore, there is provided a fastening or blocking device 15' for anchoring the mobile or displaceable transport unit 1 in position in a manner which reduces vibrations, as well as a pulling eye 14 or the like intended for horizontal transport. The illustrated displaceable mobile transport unit 1 further possesses a protective grating or railing 16 which surrounds, as a safeguard for the operating personnel, the infeed and/or outfeed means 45 of the holding means 4 as far as such holding means 4 project into the walkable passageway 15. There is thus substantially eliminated the danger of injuries to personnel caused by the rapidly reciprocating working table or plate 44. Still further, the manual feed control 72 is arranged at the outside of the further cabin or cell 3 and on the side facing the walkable passageway 15 for the purpose of, for example, switching operating, altering operating parameters, reading data or the like and other activities carried out by the operating personnel.

It is repeated here that the presently described embodiment of the mobile or displaceable transport unit 1 provided with the supporting main or base frame 11 or base plate 11A which supports the two cabins 2 and 3, is not limited to an arrangement in which one of the two cabins or cells contains the actual cutting apparatus from which high-pressure liquid is discharged, and an other one of the two cells is provided for essentially accommodating the high-pressure liquid producing means as well as the switching and control means. Contrary thereto, also the high-pressure liquid producing means and, if desired, all of the control means, processors and so forth can also be arranged conjointly with the other aforementioned components in a single cabin or cell. Advantageously, the conduits for the supply of the high-pressure cutting liquid or medium, for the withdrawal of used or spent cutting liquid or medium, and further the electrical conductors and control lines, all of which are not shown in the drawings, are arranged substantially in a plane defined by the main or base frame 11 where high rigidity and special protection are offered Using the mobile transport unit of the type as shown in the drawings, there can be achieved, during the production of dash boards and bumpers made of fiber reinforced plastic at different locations of a production line, highest cutting precision and high flexibility during custom manufacture of small series. This result is obtained with low idle times due to positional changes of the liquid jet cutting machine 100 and at the same time high personnel and environmental protection are achieved.

While there are shown and described present preferred embodiments of the invention, it is to be distinctly understood that the invention is not limited thereto, but may be otherwise variously embodied and practiced within the scope of the following claims.

Accordingly, what we claim is:

1. A high-pressure liquid jet cutting machine for cutting workpieces, especially flat workpieces, comprising:
   - at least one high-pressure liquid producing means for producing a high-pressure cutting liquid;
   - at least one cutting head operatively connected with said high-pressure liquid producing means and delivering a high-pressure liquid cutting jet;
   - guide means for guiding a controlled movement of said cutting head during a cutting operation;

holding means for holding said workpiece at least during said cutting operation;

cutting jet collecting means for collecting spent cutting liquid;

connecting elements for providing power supply connections and liquid supply as well as spent liquid drain connections at the high-pressure liquid jet cutting machine;

a mobile transport unit;

said at least one high-pressure liquid producing means, said at least one cutting head, said guide means, said holding means, said cutting jet collecting means, and said collecting elements being at least indirectly connected with said mobile transport unit;

blocking means for blocking said mobile transport unit at a preselected location;

said at least one cutting head, said guide means and said holding means each define an associated working area;

said mobile transport unit containing a predetermined number of cells;

one of said predetermined numbers of cells surrounding substantially on all sides said at least one cutting head and the associated working area thereof, said guide means and the associated working area thereof, said holding means and the associated working area thereof, and said cutting jet collecting means;

said one cell containing ultrasound damping means surrounding substantially on all sides and in an ultrasound damping manner said at least one cutting head and the associated working area thereof, said guide means and the associated working area thereof, said holding means and the associated working area thereof, and said cutting jet collecting means;

said predetermined number of cells on said mobile transport unit contains one further cell;

said one further cell surrounding said high-pressure liquid producing means;

said one further cell containing ultrasound damping means surrounding substantially on all sides and in an ultrasound damping manner said high-pressure liquid producing means;

a walkable passageway;

said walkable passageway spatially separating said one cell and said further cell of said predetermined number of cells on said mobile transport unit;

said holding means containing at least workpiece infeed means facing said walkable passageway.

2. The machine as defined in claim 1, wherein:

said at least one high-pressure liquid producing means producing a high-pressure cutting liquid having a pressure in excess of 1,000 bar.

3. The machine as defined in claim 1, wherein:

said high-pressure liquid producing means containing a drive unit.

4. The machine as defined in claim 1, wherein:

said guide means guiding said at least one cutting head along a predetermined cutting path during said cutting operation.

5. The machine as defined in claim 4, wherein:

said guide means automatically guiding said at least one cutting head along said predetermined cutting path during said cutting operation.

6. The machine as defined in claim 1, wherein:

said guide means constitute an industrial robot.

7. The machine as defined in claim 1, wherein:

said holding means constitute displaceable holding means; and displacing means controlling the displacement of said displaceable holding means.

8. The machine as defined in claim 7, wherein:

said mobile transport unit contains a common main frame supporting said at least one said high-pressure liquid producing means, said at least one cutting head, said displacing means, said holding means, said cutting jet collecting means, and said connecting elements.

9. The machine as defined in claim 8, wherein:

said common main frame constitutes a multi-part frame.

10. The machine as defined in claim 8, wherein:

said common main frame containing a common base plate.

11. The machine as defined in claim 1, wherein:

said holding means contain workpiece infeed means; and said holding means further containing workpiece outfeed means.

12. The machine as defined in claim 11, wherein:

said holding means constitute combined workpiece infeed and outfeed means; and said combined workpiece infeed and outfeed means constitute a slidable table.

13. The machine as defined in claim 1, further including:

drain means for draining spent cutting liquid; and said drain means being operatively associated with said cutting jet collecting means.

14. The machine as defined in claim 13, wherein:

said drain means contain at least one collecting tank.

15. The machine as defined in claim 1, wherein:

said at least one high-pressure liquid pressure producing means, said at least one cutting head, said guide means, said holding means, said cutting jet collecting means, and said connecting elements being releasably connected with said mobile transport unit.

16. The machine as defined in claim 1, wherein:

said connecting elements constitute plug-type connecting elements.

17. The machine as defined in claim 1, wherein:

said blocking means contain vibration damping means for anchoring said mobile transport unit at said preselected location substantially in a vibration-damping manner.

18. The machine as defined in claim 1, wherein:

said mobile transport unit contains a common main frame; and said one cell being mounted at said common main frame:

19. The machine as defined in claim 1, wherein:

said one cell containing ultrasound damping walls constituting said ultrasound damping means.

20. The machine as defined in claim 1, wherein:

said one cell is substantially quadrangularly shaped.

21. The machine as defined in claim 1, wherein:

said further cell is arranged separate from said one cell of said predetermined number of cells arranged on said mobile transport unit.

22. The machine as defined in claim 1, further including;

control means for controlling the operation of the liquid jet cutting machine;

said control means being arranged in said further cell; and said control means being surrounded substantially on all sides and in an ultrasound damping manner by said ultrasound damping means of said further cell.

23. The machine as defined in claim 22, wherein:

said control means for controlling the operation of the liquid jet cutting machine contain electric power control means.

24. The machine as defined in claim 23, wherein:

said control means contain program control means.

25. The machine as defined in claim 22, wherein:

said control means contain manual control means.

26. The machine as defined in claim 1, wherein:

said mobile transport unit contains a main frame; and said one cell and said further cell of said predetermined number of cells being arranged on said main frame.

27. The machine as defined in claim 1, wherein:

said one cell surrounds said guide means for guiding said controlled movement of said cutting head during said cutting operation.

28. The machine as defined in claim 1, wherein:

said holding means further contain workpiece outfeed means.

29. The machine as defined in claim 1, wherein:

said holding means contain combined workpiece infeed and outfeed means.

30. The machine as defined in claim 1, wherein:

said predetermined number of cells arranged on said mobile transport unit constitute said one cell and a further cell;

each one of said one cell and said further cell containing a base region;

said mobile transport unit containing a main frame;

said base regions of said one cell and said further cell being arranged substantially in the region of said main frame; and ultrasound damping means arranged substantially in the base regions of said one cell and said further cell.

31. The machine as defined in claim 30, wherein:

said ultrasound damping means constitute related ultrasound damping walls mounted in said base regions of said one cell and said further cell.

32. The machine as defined in claim 1, wherein:

said mobile transport unit contains at least passive transport assisting elements.

33. The machine as defined in claim 32, wherein:

said mobile transport unit contains a main frame; and said at least passive transport assisting elements being mounted at said main frame of said transport unit.

34. The machine as defined in claim 32, wherein:

said at least passive transport assisting means constitute at least one suspending hook.

35. The machine as defined in claim 32, wherein:

said at least passive transport assisting means constitute at least one eye.

36. The machine as defined in claim 32, wherein:

said at least passive transport assisting means constitute a predetermined number of rollers.

37. The machine as defined in claim 32 wherein:

said at least passive transport assisting means constitute a predetermined number of wheels.

* * * * *